United States Patent [19]

Yuyama et al.

[11] Patent Number: 4,622,279

[45] Date of Patent: Nov. 11, 1986

[54] LIGHT TRANSMISSIBLE LIGHT-SENSITIVE RECORDING MATERIALS

[75] Inventors: Yasuaki Yuyama; Syunichi Kondo; Hideo Sato, all of Kanagawa, Japan

[73] Assignee: Fuji Photo Film Co., Ltd., Kanagawa, Japan

[21] Appl. No.: 732,772

[22] Filed: May 10, 1985

[30] Foreign Application Priority Data

May 11, 1984 [JP] Japan ..... 59-95270

[51] Int. Cl.[4] ..... G03C 1/76; G03C 1/96; G03G 5/10; G03G 5/14

[52] U.S. Cl. ..... 430/66; 430/56; 430/496; 430/527

[58] Field of Search ..... 430/56, 66, 496, 501, 430/527, 961, 530, 529, 523, 531, 533, 536

[56] References Cited

U.S. PATENT DOCUMENTS

| | | | |
|---|---|---|---|
| 1,697,858 | 1/1929 | Fiedler | 430/496 |
| 2,384,657 | 9/1945 | Tyler | 430/527 |
| 3,206,311 | 9/1965 | Campbell et al. | 430/496 |
| 3,503,749 | 3/1970 | Kosar | 430/530 |
| 3,539,344 | 11/1970 | Russell | 430/496 |
| 4,467,023 | 8/1984 | Chu et al. | 430/66 |
| 4,543,307 | 9/1985 | Drexler et al. | 430/501 |

OTHER PUBLICATIONS

"Photographic Silver Halide . . . Systems", *Research Disclosure* No. 17643, 12/1978, pp. 22–31.

*Primary Examiner*—Richard L. Schilling
*Attorney, Agent, or Firm*—Sughrue, Mion, Zinn, Macpeak & Seas

[57] ABSTRACT

In a light transmissible light-sensitive recording material, the improvement wherein said recording material is a long film having a width of 40 mm or less, and both sides of at least one surface of said film each have an image protective zone having a kinetic friction coefficient of 0.35 or less which are provided in the lengthwise direction of the film in parallel with each other, is disclosed.

8 Claims, No Drawings

LIGHT TRANSMISSIBLE LIGHT-SENSITIVE RECORDING MATERIALS

FIELD OF THE INVENTION

The present invention relates to light transmissible long light-sensitive recording materials.

In greater detail, it relates to light-sensitive materials wherein wear of the image recorded on the light-sensitive recording material is prevented and the image can be repeatedly used.

BACKGROUND OF THE INVENTION

As light-sensitive materials to which the present invention can be applied, there are, for example, light transmissible electrophotographic films, silver salt films (silver dry films comprising silver halide or an organic silver salt such as silver behenate, silver benzotriazole, etc., as a main component, as described in Japanese Patent Publications Nos. 2096/63, 4921/68 and 4924/68, etc.) and heat developable films as described in Japanese Patent Publications Nos. 35484/79 and 2687/78.

For the above described light-sensitive materials, the prior art will be illustrated with reference to only the case of light transmissible electrophotographic materials, but the discussion thereon applies to the other light-sensitive materials with equal force.

A process which comprises forming a toner image on an electrophotographic light-sensitive material and thereafter transferring the toner image to plain paper and a process which comprises forming an image on a recording material comprising an electrophotographic light-sensitive material on a base such as paper or film, etc., are known as processes for forming images by electrophotography.

In the early days of the electrophotographic art, raw materials used for electrophotographic light-sensitive materials were commonly inorganic substances such as selenium, cadmium sulfide, zinc oxide, etc. In recent years, however, organic electrophotographic light-sensitive materials, for example, electrophotographic light-sensitive materials composed of poly-N-vinylcarbazole and 2,4,7-trinitrofluorene-9-one (U.S. Pat. No. 3,484,237), those in which poly-N-vinylcarbazole is sensitized with pyrylium salt dyes (Japanese Patent Publication No. 25658/73), electrophotographic light-sensitive materials comprising an organic pigment as a main component (Japanese Patent Application (OPI) No. 37543/72 (the term "OPI" as used herein refers to a "published unexamined Japanese patent application")) and electrophotographic light-sensitive materials comprising an eutectic crystal complex composed of a dye and a resin as a main component (Japanese Patent Application (OPI) No. 10735/72), etc., have been proposed; they are easily processed by applying the organic photoconductive substance directly or by mixing it with a suitable binder.

Further, it has become possible to produce light transmissible electrophotographic recording materials by selecting a suitable organic photoconductive substance and a base. Disclosure thereon occurs in *Optical Eng.*, Vol. 20, No. 3, page 365 (1981).

Generally, recording materials for electrophotography have excellent characteristics as compared with silver halide photographic recording materials conventionally used.

For example, electrophotographic recording materials are easily produced and processed, packing is simple and processing such as development, etc., can be simply carried out as they are not light-sensitive until they have been subjected to charging.

Further, as a singular characteristic of the electrophotographic process, there is the fact that exposure and development can be repeatedly carried out using one recording material. Namely, in silver halide recording materials if a developed image is once formed, another image cannot be recorded on the same recording material. However, electrophotographic materials have the characteristic that the image can be recorded at a desired position of the recording material whenever recording is required.

Conversely, in the case of long film of electrophotographic recording materials, there is the fault that when charging, exposure and development are electrophotographically carried out, the electrically conductive substance present comes off during conveying and adheres to the nonexposed surface or the electrostatically charged surface of the exposed light-sensitive layer to cause a part of electric charges present to "leak off", whereby the image is electrostatically damaged to cause image defect.

With respect to the above problem, it is disclosed in Japanese Patent Publication No. 6150/71 that charge removal zones can be provided on both sides of the long film in the lengthwise direction to help to overcome the same.

Another fault of electrophotographic processes is that the image is inferior in resistance to friction and is easily damaged when repeatedly used; this is because toner adheres only to the uppermost layer of the recording material to form the desired image.

With respect to this problem, charge removal zones as described in the above described Japanese Patent Publication No. 6150/71 show some effect as image protective zones, but they are not satisfactory because the charge removal zones wear during repeated use.

SUMMARY OF THE INVENTION

An object of the present invention is to prevent damage of the surface of recording materials and recorded images caused by friction.

Another object is to improve the wear resistance of protective zones for preventing the above described damage.

As a result of research by the present inventors, the objects of the present invention were reached by providing light transmissible light-sensitive recording materials which are characterized by the recording material being a long film having a width of 40 mm or less, wherein both sides of at least one surface of the film each have an image protective layer having a kinetic friction coefficient of 0.35 or less which are provided in the lengthwise direction of the film in parallel with each other.

DETAILED DESCRIPTION OF THE INVENTION

The image protective layer in the present invention comprises at least a binder and a lubricant, but it can contain, if desired or necessary, antistatic agents, coating aids and pigments, etc.

The binder is not particularly restricted if it is a synthetic or natural high molecular weight compound soluble in water or an organic solvent, which has a film forming ability. For example, as synthetic high molecular weight polymers, there are polyamide resins, vinyl resins such as polyacrylonitrile, polyvinyl alcohol, polyvinyl chloride, polyvinylidene chloride, polycarbonate resins, polyester resins, unsaturated polyester resins, polystyrene resins, polyethylene resins, acryl resins such as polyethyl acrylate, polyethyl methacrylate, etc., and synthetic rubbers such as butadiene-acrylonitrile rubber, butadiene-styrene rubber, polybutadiene rubber, etc.

As natural high molecular weight polymers, there are cellulosic polymers such as cellulose acetate or nitrocellulose, etc., protein based polymers such as casein, etc., and natural rubber and derivatives thereof, such as gutta percha, balata, etc.

As suitable binders, there are cellulose high polymers such as cellulose acetate or nitrocellulose, polycarbonate resins, saturated polyesters and acryl resins such as polyethyl methacrylate, etc., which should not have a harmful influence on photographic properties and should have a suitable hardness and flexibility.

As lubricants, there can be illustrated organic silicon compounds such as dimethyl silicon, diphenyl silicon, methylphenyl silicon, etc.; hydrocarbons such as paraffin, low molecular weight polyethylenes, etc.; aliphatic acids such as stearic acid, oleic acid, etc.; metal soaps which are metal salts of aliphatic acids such as stearic acid, oleic acid, etc.; inorganic powders such as silicon oxide, titanium oxide, strontium barium nitrate, barium carbonate, magnesium carbonate, etc.; and organic powders such as methyl methacrylate resins, urea-formaldehyde resins, etc. Particularly suitable lubricants are silicon dioxide and metal soaps represented by the following general formula (I) which do not have a harmful influence on photographic properties.

$$(RCOO)_nM \qquad (I)$$

In the above formula, R represents an alkyl group having 12 to 21 carbon atoms, M represents a 1- to 3-valent metal and n represents an integer of 1, 2 or 3. Examples of "metal" in the above described general formula include calcium, magnesium, lead, zinc, aluminum, sodium, etc.

As antistatic agents, those having compatibility with the binder are preferred. Examples include anionic surface active agents such as alkyl sulfates, alkylaryl sulfates, alkyl acid phosphates, alkyl phosphates, etc.; cationic surface active agents such as amine neutral salts, quaternary ammonium salts, complex ionic salts, etc.; ampholytic surface active agents such as betaine, heavy metal salts of sulfobetaines, etc.; nonionic surface active agents such as sorbitan fatty acid ester monoglycerides, polyoxyethylene alkyl ethers, polyoxyethylene alkylamines, trialkyl phosphates, etc.; and semipolar surface active agents such as amine oxides, bisglyceryl borate monoalkylates, etc.

As coating aids, the above described antistatic agents can be used. In addition, there are nonionic surface active agents such as alkylene oxide derivatives, aliphatic acid esters of polyhydric alcohols, etc.; anionic surface active agents such as alkylbenzenesulfonates, alkylphosphoric acid esters, etc.; ampholytic surface active agents such as amino acids, etc.; and cationic surface active agents such as aliphatic or heterocyclic phosphonium salts, etc.

In order to check leakage of light from the developing apparatus or discriminate the kind of film, pigments such as phthalocyanine pigments, anthraquinone pigments, etc., can be added, if desired or necessary.

The image protective zone in the present invention is formed by applying a coating solution prepared by adding a binder, a lubricant and, if desired or necessary, an antistatic agent, a coating aid, or a pigment, to water or an organic solvent to dissolve or disperse the same therein. As the organic solvent, there are ketones such as acetone, methyl ethyl ketone, cyclohexanone, etc.; aromatic hydrocarbons such as benzene, toluene, xylene, etc.; chlorinated hydrocarbons such as chloroform, dichloroethane, methylene chloride, etc.; ethers such as tetrahydrofuran, dioxane, etc.; alcohols such as methanol, ethanol, isopropanol, etc.; esters such as ethyl acetate, butyl acetate, etc.; and non-protonic polar solvents such as N-dimethylformamide, dimethyl sulfoxide, etc., but the organic solvent is not restricted to the recited solvents.

The solids in the ccating solution are determined so as to provide a kinetic friction coefficient of 0.35 or less in the image protective zone, to insure adhesion to the coated surface of the light-sensitive recording material and to provide flexibility and a suitable hardness to the image protective zone. The binder is preferably used in a range of about 50 to 99.5 parts by weight and the lubricant is preferably used in a range of about 0.5 to 50 parts, based on 100 parts by weight of solids present. If desired or necessary, one can add the antistatic agents in a range of about 3 to 30 parts by weight, the coating aids in a range of about 1 to 20 parts by weight, and the pigment in a range of about 0.01 to 5 parts by weight, based on 100 parts by weight of solids. The solid content in the coating solution is preferably about 0.5 to 20% by weight.

Application of the coating solution can be carried out by known methods, e.g., gravure coating, spray coating, slit coating, roller coating, etc., and the coating solution may be applied to the surface of the light-sensitive recording layer, to the surface of the base of the reverse side, or to the surface of a backing layer, if present. Further, the same may be applied to both surface sides of the light-sensitive recording material. In the case of providing the same only on one side, it is convenient to provide on the reverse side of the light-sensitive recording layer in the viewpoint of the facilities of production. Prior to providing the image protective zone, an intermediate layer (adhesive layer) may be provided, if desired. As an example of the intermediate layer, there is a layer comprising polycarbonate (20 parts by weight, hereinafter the same), Stafix (commercial name, produced by Fuji Photo Film Co., Ltd.) (1.0 part), cyclohexanone (25 parts) and dichloromethane (100 parts).

The coating solution may be applied to a "master" roll prior to cutting the light-sensitive recording material into final use form, but it is preferred to apply the same after cutting into final use form because of better final product production accuracy.

The image protective zone of the present invention provides good results if it has a width of about 0.3 mm or more, preferably about 0.5 mm or more. The width can be arbitrarily selected so long as it does not enter into the image region, however, it may not more than 20 mm. The thickness can be arbitrarily selected as about 3 μm or more, but it is preferably in a range of about 5 to 100 μm, most preferably about 5 to 50 μm.

The position of the image protective zone is along both sides of the film parallel to the lengthwise direction, and it is preferably as near the image as possible.

The kinetic friction coefficient of the image protective zone can be determined by the method of ASTM D1894. For example, using a kinetic friction tester: Heidon type 14 (produced by Shinto Kagaku Co.).

The kinetic friction coefficient is 0.35 or less, and preferably 0.3 or less.

As bases for the light transmissible light-sensitive recording materials of the present invention, one can use those composed of semi-synthetic or synthetic high molecular weight polymers such as cellulose nitrate, cellulose acetate, polystyrene, polyvinyl chloride, polyethylene terephthalate, polycarbonate, etc. In the case of light transmissible electrophotographic recording materials, it is preferred to use those obtained by the coating or vacuum evaporation of an electrically conductive compound such as an electrically conductive polymer (e.g., polyvinylpyridine hydrochloride), indium oxide, tin oxide, etc., on the above described bases, and, particularly, polyethylene terephthalate film bases to which indium oxide has been applied by vacuum evaporation.

The light-sensitive recording materials of the present invention are used in the state of a long film having a width of 40 mm or less, but the length thereof is not restricted. The effects of the present invention are shown when width is 40 mm or less, and those having a width of 35 mm (conventional in silver halide long films) are generally used. More suitably, those having a width of 16 mm or 8 mm are used.

In the light-sensitive recording materials used in the present invention, if necessary, an undercoat layer or a surface protective layer as well as the intermediate layer and the backing layer as described before may be provided, in addition to the light-sensitive layer. In the case of electrophotographic recording materials, an organic photoconductive layer and, if desired or necessary, an intermediate layer and a backing layer can be provided.

As the organic photoconductive layer, there are those of the monolayer type where an organic photoconductive substance is dispersed in a binder or an electric charge carrier, or of the lamination type where a layer of an electric charge carrier is provided on a layer containing an organic photoconductive substance.

Since the organic photoconductive layer, the intermediate layer and the backing layer can be formed of and by well known materials and methods, and are conventional, further detail is not provided.

The present invention will now be further illustrated with reference to Examples illustrating preferred modes of the invention.

EXAMPLE 1

A light transmissible electrophotographic film XP5-008 (produced by James River Graphics Co.) available in the market was cut to produce a long film having a width of 16 mm and a length of 5 m.

The following composition was stirred by a high speed mixer (produced by Nippon Seiki Co.) at 150 rpm for 30 minutes to produce a coating solution. It was applied by a conventional continuous coating apparatus equipped with a spool type coating roll to the back surface of the above described cut electrophotographic long film so that two image protective zones were formed on each edge of the back side of the film, and the film was dried at 50° C. for 10 minutes.

| Composition | parts by weight |
|---|---|
| Triacetyl Cellulose (molecular weight: about 50,000) | 3 |
| Sodium Stearate | 0.2 |
| Dichloromethane | 50 |
| Methanol | 5 |
| Chlorobenzene | 10 |

The obtained image protective zones had a thickness of 15 μm and a width of 1 mm, and they extended in parallel throughout the whole length at a distance of 0.1 mm from the edge of the film.

The electrophotographic film thus provided with image protective zones was then charged by negative corona discharge (700 v), and imagewise exposed. An image was then formed with a positively charged toner: T48A-18 (produced by James River Graphics Co.).

For comparison, an electrophotographic film (Comparative Example A) where an image was formed in the same manner as above except that sodium stearate was deleted from the above described coating composition and an electrophotographic film (Comparative Example B) where an image was formed in the same manner as above except that the image protective zone was not formed were produced. The image protective property of the resultant films was examined in the following manner.

Measurement of Kinetic Friction Coefficient

Measurement was carried out using a kinetic friction testing apparatus: Heidon type 14 (produced by Shinto Kagaku Co.). A sample obtained by cutting the above described electrophotographic film to a length of 63 mm was attached to a pressure terminal of the testing apparatus at the surface side, and a weight of 20 g was applied thereto. The pressure terminal was then brought into contact with a polyethylene terephthalate film (thickness: 100 μm) having a size of 5 cm×15 cm previously fixed on a flat table.

The resistance of the pressure terminal when it was subjected to sliding at a rate of 50 mm/min was detected by a strain gauge and automatically recorded on a chart.

Examination of Image Protective Property

Two revolving rolls were placed in parallel at an interval of 70 mm and a feed reel and a winding reel for the electrophotographic film were placed outside the revolving rolls at a distance of 100 mm so that the film sent out from the feed reel turned at a right angle to the first revolving roll and turned again at a right angle to the second revolving roll to reach the winding roll. That is, the feed reel and the winding reel were arranged in such a position that the back surface of the film sent out from the feed reel moved in contact with the two revolving rolls and thereafter it was wound on the winding reel. The tension between the reels was adjusted to about 300 g and the film was moved back and forth 1,000 times by an automatic driving apparatus. After being allowed to so move, damage to the film surface and the image were visually measured by magnifying the same 19 times by a Canolama printer T370TB (produced by Canon Inc.) and compared with a film which was not so moved.

TABLE 1

| Film | Evaluated Item | | | |
|---|---|---|---|---|
| | Kinetic Friction | | Damage of Film Surface | Damage of Image |
| Example 1 | Image protective zone | 0.28 | No abrasion | No abrasion |
| Comparative Example A | Image protective zone | 0.40 | No abrasion | Partial abrasion |
| Comparative Example B | Back surface | 0.38 | Much abrasion | Considerable abrasion |

In Example 1, no abrasion was observed on the film surface and damage to the image was not observed. However, in Comparative Example A, though abrasion was not observed on the film surface, the image protective zones were worn and a part of the image was damaged. In Comparative Example B, much abrasion was observed on the film surface and the image was greatly damaged.

In Example 1, a waving phenomenon of sides of the rolled film due to the difference of diameter of the rolled film at a portion having the image protective zone and at a portion without having it did not occur.

EXAMPLE 2

Ektavolt type SO-102 (produced by Eastman Kodak Co.), a light transmissible electrophotographic film available in the market, was cut to a width of 35 mm and a length of 300 m to obtain a long electrophotographic film. The following composition was then applied to the back surface of the resulting film in the same manner as in Example 1 and dried at 80° C. for 5 minutes to provide image protective zones.

The image protective zones in this case had a thickness of 20 μm and a width of 1.8 mm, and they extended in parallel in the lengthwise direction of the film throughout the whole length of the film at a distance of 0.1 mm from the edge of the film.

| Composition | parts by weight |
|---|---|
| Diacetyl Cellulose (molecular weight: about 40,000) | 5 |
| Silicon Dioxide (average size: about 0.5 μm) | 0.2 |
| Antistatic agent $-(CH_2\underset{\underset{COONa}{\vert}}{CH})_n-$ (molecular weight: $1 \times 10^5$) | 0.5 |
| Acetone | 50 |
| Methyl Ethyl Ketone | 20 |

For comparison, an electrophotographic film (Comparative Example C) in which image protective zones were formed with the above described composition but where silicon dioxide was deleted, and an electrophotographic film (Comparative Example D) in which image protective zones were not formed were produced.

The resulting films were charged by positive corona discharge (700 v). After they were imagewise exposed to white light (200 lux.sec.), image formation was carried out using a negatively charged liquid developer: Ricoh MRP (produced by Ricoh Co.).

The kinetic friction coefficient and image protective property were measured in the same manner as in Example 1. The results are shown in Table 2.

TABLE 2

| Film | Evaluated Item | | | |
|---|---|---|---|---|
| | Kinetic Friction | | Damage of Film Surface | Damage of Image |
| Example 2 | Image protective zone | 0.26 | No abrasion | No damage |
| Comparative Example C | Image protective zone | 0.38 | Some abrasion | Partial damage |
| Comparative Example D | Back surface | 0.23 | Some abrasion | Considerable damage |

As will be obvious from Table 2, the properties of the film of Example 2 were excellent.

In Example 2, problems of the waving phenomenon as described in Example 1 also did not occur.

EXAMPLE 3

To the back surface of the same long electrophotographic film as used in Example 1 and formed by cutting as in Example 1, the following composition was applied as an undercoat layer in the same manner as the image protective zones in Example 1. The undercoat layer had a thickness of 1 μm and a width of 1.2 mm.

| Composition for Undercoat Layer | parts by weight |
|---|---|
| Stafix (commercial name, produced by Fuji Photo Film Co. Ltd.) | 2.5 |
| Dichloromethane | 100 |
| Chlorobenzene | 25 |

Image protective zones were then provided on the resulting undercoat layer at a distance of 0.1 mm from the edge of the film using the following composition in the same manner as in Example 1.

| Composition for Image Protective Zone | parts by weight |
|---|---|
| Polycarbonate (molecular weight: about 33,000) | 15 |
| Silicon Dioxide (average size: about 0.5 μm) | 1.5 |
| Dichloromethane | 95 |
| Chlorobenzene | 5 |

The image protective zones had a thickness of 15 μm and a width of 1 mm. Using the electrophotographic film obtained as described above, image formation was carried out in the same manner as in Example 1. When the protective property of the image protective zones was examined, there was no abrasion on the film surface and image damage was not observed.

EXAMPLE 4

An electrophotographic film was produced in the same manner as in Example 1 using the same electrophotographic film as in Example 1 except that the image protective zones were provided on the organic photoconductive layer instead of the back surface, and an image was formed as per Example 1.

When image protective property was examined in the same manner as in Example 1, it was found to be excellent because there was no abrasion on the film surface and damage to the image was not observed.

EXAMPLE 5

An electrophotographic film was produced in the same manner as in Example 1, except that zinc stearate was used instead of sodium stearate in the composition in Example 1, and an image was formed as per Example 1.

When the kinetic friction coefficient was measured in the same manner as in Example 1, it was found to be 0.26. The image protective property was excellent, i.e., there was no abrasion of the film surface and no damage to the image.

While the invention has been described in detail and with reference to specific embodiments thereof, it will be apparent to one skilled in the art that various changes and modifications can be made therein without departing from the spirit and scope thereof.

What is claimed is:

1. An electrophotographic recording material which comprises a long film having a width of 40 mm or less, and both sides of at least one surface of said film each have an image protective zone comprising about 50 to 99.5 parts by weight of a binder and about 0.5 to 50 parts by weight of a lubricant and having a kinetic friction coefficient of 0.35 or less which are provided in the lengthwise direction of the film in parallel with each other.

2. An electrophotographic recording material as claimed in claim 1, wherein the image protective zone has a width of about 0.3 mm or more and a thickness of about 5 to 100 $\mu$m.

3. An electrophotographic recording material as claimed in claim 1, wherein the binder is selected from the group consisting of cellulose high polymers, polycarbonate resins, saturated polyesters and acryl resins.

4. An electrophotographic recording material as claimed in claim 1, wherein the lubricant is selected from the group consisting of silicon dioxide and metal soaps represented by the following general formula (I):

$$(RCOO)_nM \qquad (I)$$

wherein R represents an alkyl group having 12 to 21 carbon atoms, M represents a 1- to 3-valent metal and n represents an integer of 1, 2 or 3.

5. An electrophotographic recording material as claimed in claim 1, wherein the image protective zone further contains an antistatic agent, a coating aid or a pigment.

6. An electrophotographic recording material as claimed in claim 1, wherein the image protective zone is provided on the surface of a light-sensitive recording layer of said recording material.

7. An electrophotographic recording material as claimed in claim 1, wherein the image protective zone is provided on the reverse surface side of the light-sensitive recording layer of said recording material.

8. An electrophotographic recording material as claimed in claim 1, wherein the image protective zone is provided on both surfaces of said recording material.

* * * * *